United States Patent [19]

Rawlings et al.

[11] 4,330,191

[45] May 18, 1982

[54] CONNECTOR DEVICE FOR ATTACHING PHOTOGRAPHIC WEB MATERIAL TO A LEADER BELT

[75] Inventors: Robert M. Rawlings, Brooklyn Park; Derold D. Heim, Long Lake; Ronald E. Morain, Shakopee, all of Minn.

[73] Assignee: Pako Corporation, Minneapolis, Minn.

[21] Appl. No.: 235,105

[22] Filed: Feb. 17, 1981

[51] Int. Cl.[3] ..... G03D 13/10; G03D 3/13

[52] U.S. Cl. ..... 354/345; 226/92; 226/173

[58] Field of Search ..... 354/320, 321, 322, 340, 354/343, 344, 345, 346; 242/58; 226/91, 92, 170, 173

[56] References Cited

U.S. PATENT DOCUMENTS

| | | | |
|---|---|---|---|
| 2,812,937 | 11/1957 | Robinson | 226/92 |
| 4,044,964 | 8/1977 | Kellett | 242/58 |
| 4,065,042 | 12/1977 | Zielinski | 226/92 |
| 4,068,250 | 1/1978 | Anderson et al. | 354/316 |
| 4,072,260 | 2/1978 | Dove | 226/173 |
| 4,140,383 | 2/1979 | Schmidt | 226/92 |
| 4,161,269 | 7/1979 | Kirkpatrick | 226/92 |
| 4,188,108 | 1/1980 | Falomo | 354/345 |
| 4,279,371 | 7/1981 | Laar et al. | 226/91 |

*Primary Examiner*—L. T. Hix
*Assistant Examiner*—Alan Mathews
*Attorney, Agent, or Firm*—Kinney, Lange, Braddock, Westman and Fairbairn

[57] ABSTRACT

A connector device attaches the leading end of a photographic print paper web to a leader belt of a photographic print processor and leads the print paper through the processor. The device includes a belt clip, a leader bar, a pull bar and a flexible connective flap member. When the belt clip is initially attached by an operator to the leader belt, the leader bar (which is rigidly attached to the belt clip) is in a first position which is generally perpendicular to the leader belt. The flexible connective flap member connects the leader bar and the pull bar in a fixed nonparallel relationship. A leading end of the print paper web is attached to the pull bar. When the leader belt is placed in motion, tension is transmitted from the leader belt through the connector device to the print paper web. The tension causes the leader bar to move from the first position to a second position with respect to the leader belt which results in the pull bar moving to a perpendicular position with respect to the leader belt. The print paper web, therefore, is maintained parallel to the leader belt as it is pulled through the processor.

17 Claims, 7 Drawing Figures

CONNECTOR DEVICE FOR ATTACHING PHOTOGRAPHIC WEB MATERIAL TO A LEADER BELT

BACKGROUND OF THE INVENTION

1. Field of the Invention

The present invention relates to a connector device for attaching a photographic print paper web to a leader belt of a photographic processor. In particular, it relates to a device that pulls the photographic print paper web through the processor in a parallel relationship to the leader belt.

2. Description of the Prior Art

A leader belt is used to introduce and transport a photographic print paper web into and through a photographic print paper processor. A plurality of rollers drive the leader belt, which pulls the photographic print paper web in a serpentine fashion through the processor.

While leader belt transport systems are highly successful in transporting relatively narrow webs, problems have occurred in the prior art processors in attaching print paper webs having widths of 8 inches or more to a leader belt. These wide photographic print paper webs are commonly used by "package printers", which produce multiple prints (typically portraits) of the same image. The processors which handle wide paper webs are typically required to accept many different paper widths (both wide and narrow) in order to accommodate paper webs from various photographic printers, including package printers.

The print paper travel path in the typical processor is extremely long and the threading of the print paper web in a non-skewed manner through the processor is of extreme importance in avoiding print paper waste or damage. When a wide paper web is merely clipped to one leader belt, it tends to become skewed with respect to the leader belt as it is pulled through the processor. Once having become skewed, the paper web is very difficult to straighten out. If the web is skewed, it tends to jam and bunch up among various rollers conveying the web.

In an attempt to solve the skewing problem encountered with wide webs, it has been common in the past to clip the web to two or more leader belts, rather than just one. This technique, however, also has drawbacks because the leader belts typically move at slightly different speeds. The difference in leader belt speeds arises from motor drive differences, from small differentials in roller diameters of the rollers driving the belts, and from bowing of the shafts on which the rollers are mounted due to belt tension. Synchronizing leader belt speeds in the processor in order to feed the print paper web properly through the processor is often difficult and time-consuming.

Two prior art patents which show devices that attach photographic print paper to leader belts are the Anderson et al. U.S. Pat. No. 4,068,250 and the Kellett U.S. Pat. No. 4,044,964, which are assigned to the same assignee as the present application. Both patents show a belt clip with a rigid bar extending therefrom. The belt clip is clipped to a leader belt and the bar extends from the belt clip perpendicularly to the leader belt. The paper web is attached to the rigid bar. This type of device functions properly for narrow photographic print paper webs, but when a wider print paper web, such as 8 inch or greater width print paper is to be processed, the bar does not remain perpendicular to the leader belt, but instead sags and thus threads the photographic print paper web in a skewed manner through the processor.

The Falomo U.S. Pat. No. 4,188,108 also shows a clip-on device that holds the photographic print paper web away from the leader belt. This device also does not function properly for wider paper webs and threads the wider print paper through the processor in a skewed manner.

The problem of threading the print paper through the processor is further complicated since the initial connection of the web to the leader belt must be done in the dark to avoid exposing the print paper prematurely. None of the devices described in the above-mentioned patents provides a simple and accurate method of attaching the print paper to the leader belt which can be performed in the dark and which assures feeding of the web in a non-skewed manner.

Splicing the new roll of print paper onto the previous roll, before the previous roll is taken off or completed, does not provide an adequate solution to the problem of introducing the new web into the processor. Taping the new roll onto the previous roll does not solve the problem adequately since the print paper web is a coated paper and tapes do not adhere very well to coated paper. Mechanical methods of splicing two print paper rolls are costly.

SUMMARY OF THE INVENTION

The connector device of the present invention attaches the leading end of a photographic print paper web to a leader belt of a photographic print processor and pulls the print paper web through the processor as the leader belt is driven. The device includes a belt clip for attachment to a leader belt and a leader bar rigidly attached to the belt clip in a first position with respect to the leader belt. A flexible connector flap member trails the leader bar and connects the leader bar and a trailing pull bar in a fixed and non-parallel relationship. The photographic print paper is attached to the pull bar in a position perpendicular to its longitudinal axis. When the leader belt is placed in motion, tension is transmitted to the print paper through the device, and the leader bar moves from its first position to a second position which allows the pull bar to move to a perpendicular position with respect to the leader belt so that the print paper web is aligned substantially parallel to the leader belt. The print paper is then pulled through the processor in a substantially parallel alignment with the leader belt, thus avoiding jamming and waste of print paper.

DETAILED DESCRIPTION OF THE PREFERRED EMBODIMENTS

Figure 1:
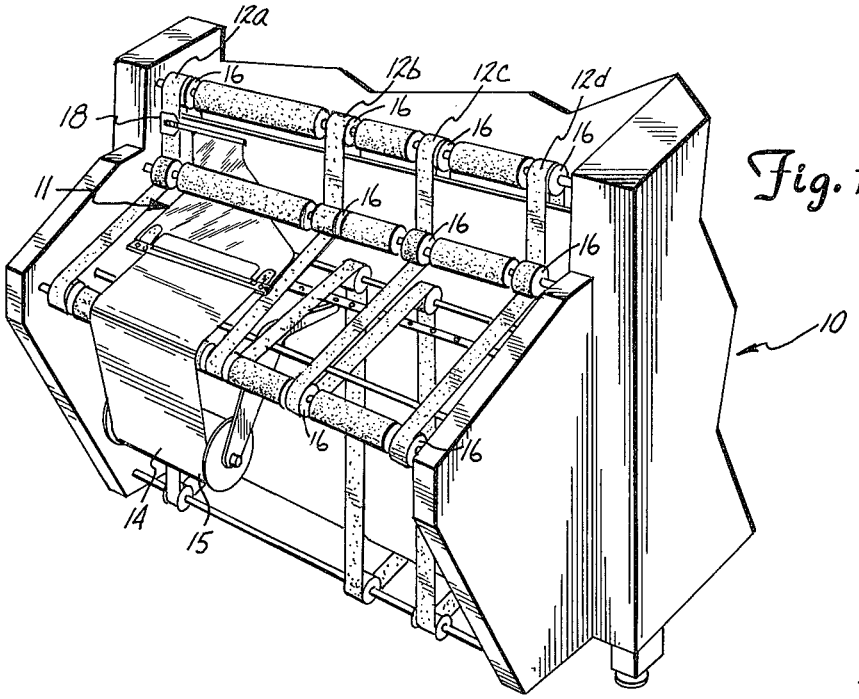
FIG. 1 is a perspective view of the leading end of a photographic paper processor with the device of the present invention threading a wide width of print paper.

A supply or loading end of photographic paper web processor 10 with connector device 11 of the present invention is shown in FIG. 1. A plurality of leader belts 12*a*–12*c* are designed to transport photographic print paper web 14 through processor 10. As shown in FIG. 1, web 14 is connected to leader belt 12*a* by connector device 11 of the present invention, so that web 14 is pulled from roll 15 and through processor 10 by leader belt 12*a*. Leader belts 12*a*–12*c* and rollers 16 form a transport system of processor 10. Rollers 16 are positioned such that leader belts 12*a*–12*c* and photographic print paper web 14 travel in a serpentine manner through the processor.

Figure 2:
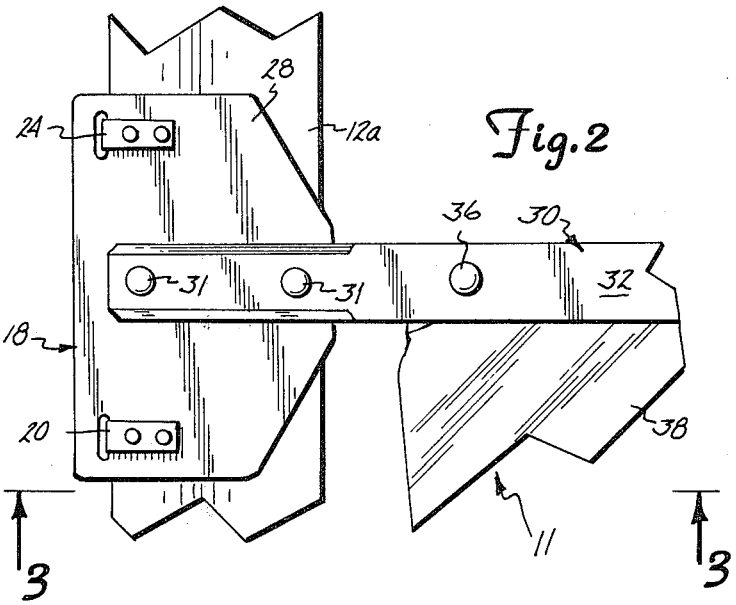
FIG. 2 is an enlarged fragmentary top view of a belt clip of the device of the present invention attached to a leader belt.
Figure 3:
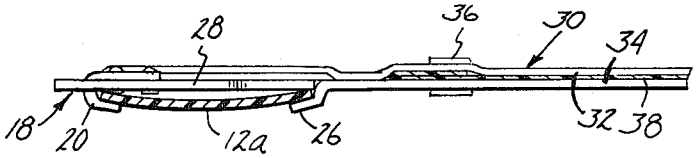
FIG. 3 is a sectional view along section 3—3 of FIG. 2 of the belt clip attached to the leader belt.

Connector device 11 includes belt clip 18, which is attached to leader belt 12*a*, as best seen in FIGS. 2 and 3. Belt clip 18 is preferably attached to leader belt 12*a* by a plurality of hooks 20, 24 and 26 on one side of belt clip 18. The preferred embodiment has two hooks 20, 24 engaging leader belt 12*a* on one side, and third hook 26 engaging belt 12*a* on an opposite side. Hooks 20, 24 and 26 preferably bow belt 12*a*, as shown in FIG. 3, to retain the main body of clip 18 frictionally in a fixed position against the belt 12*a*. A similar type of clip is shown in Kellett U.S. Pat. No. 4,044,964 assigned to the same assignee as the present application. Other devices for retaining the belt clip in a fixed position against belt 12*a* are, of course, within the scope of the present invention.

Connector device 11 also includes leader bar 30, which is rigidly attached to belt clip 18 (preferably by rivets 31) in approximately perpendicular relationship to leader belt 12*a*. Leader bar 30 preferably has top half 32 and bottom half 34. Each half is preferably flat, and halves 32 and 34 are secured to each other by rivets 36. The length L of leader bar 30 preferably is kept at a minimum to provide the least amount of resistance to the various components found in processor 10, such as wipers and spray bars.

Connector device 11 further includes flexible connector flap 38, which is fixedly attached to leader bar 30, preferably by being sandwiched by top half 32 and bottom half 34 (which are held together by rivets 36). The connector flap 38 trails leader bar 30 and has outside edge 40 which increases the width of flap 38 generally along a line formed by angle $\beta$. Angle $\beta$ typically has a value in the range of 30° to 40°. The width of the flexible connector flap 38 increases in such a manner as to offer the least amount of resistance to the various processor components that will be encountered in a threading operation. Flexible connector flap 38 is made of a material that flexes freely to allow connector flap 38 to follow the serpentine path established by leader belt 12*a* and rollers 16 in processor 10. One material that flexes freely while having the integrity to withstand tension forces and other abuses resulting from processor 10 is an ethylene chlorinated tetraflourethylene made by Allied Chemical Corp. of approximately 0.010 inch thickness.

Connector device 11 also includes pull bar 42, which is fixedly attached to flexible connector flap 38 on an end opposite from leader bar 30 by conventional means such as rivets 44. Connector flap 38 increases in width from leader bar 30 to pull bar 42. Pull bar 42 is sufficiently long to accommodate print paper from about 8 inches to about 12 inches in width. Opening 46 defined by flexible connector flap 38 and pull bar 42 allows leading end 14*a* of print paper 14 to be threaded through opening 46 and attached to pull bar 42. Opening 46 is sufficiently wide to accept print paper of widths up to about 12 inches and is at least 8 inches wide.

Figure 4:
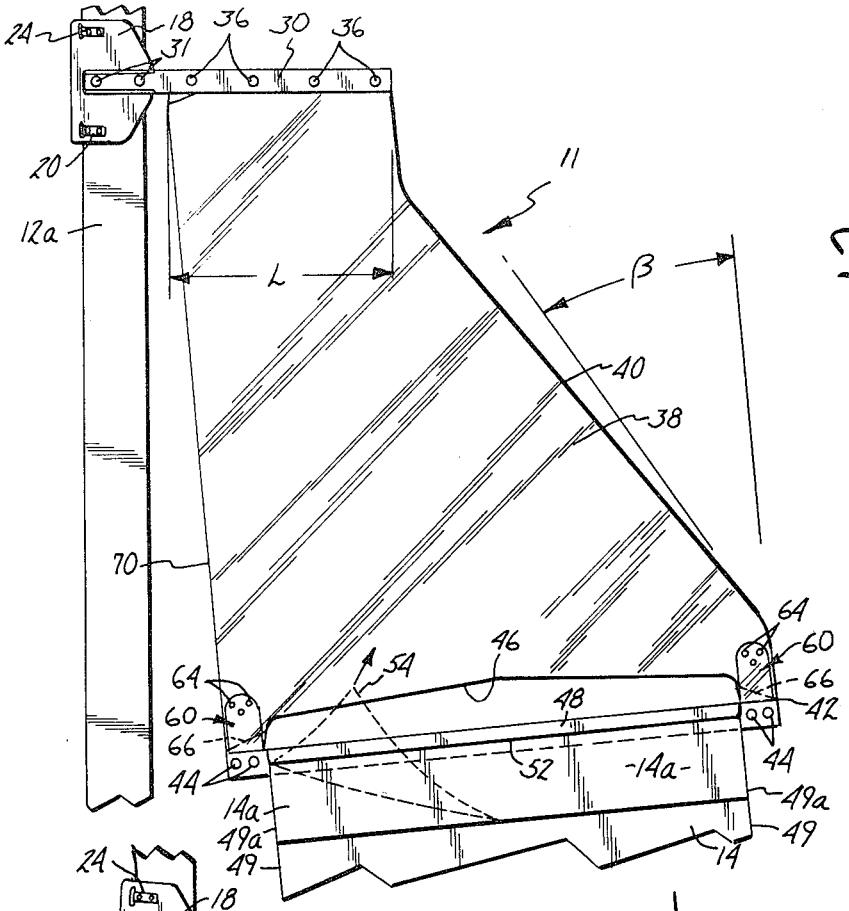
FIG. 4 is a front view of the connector device attached to the leader belt with the print paper web attached but not under tension.
Figure 5:
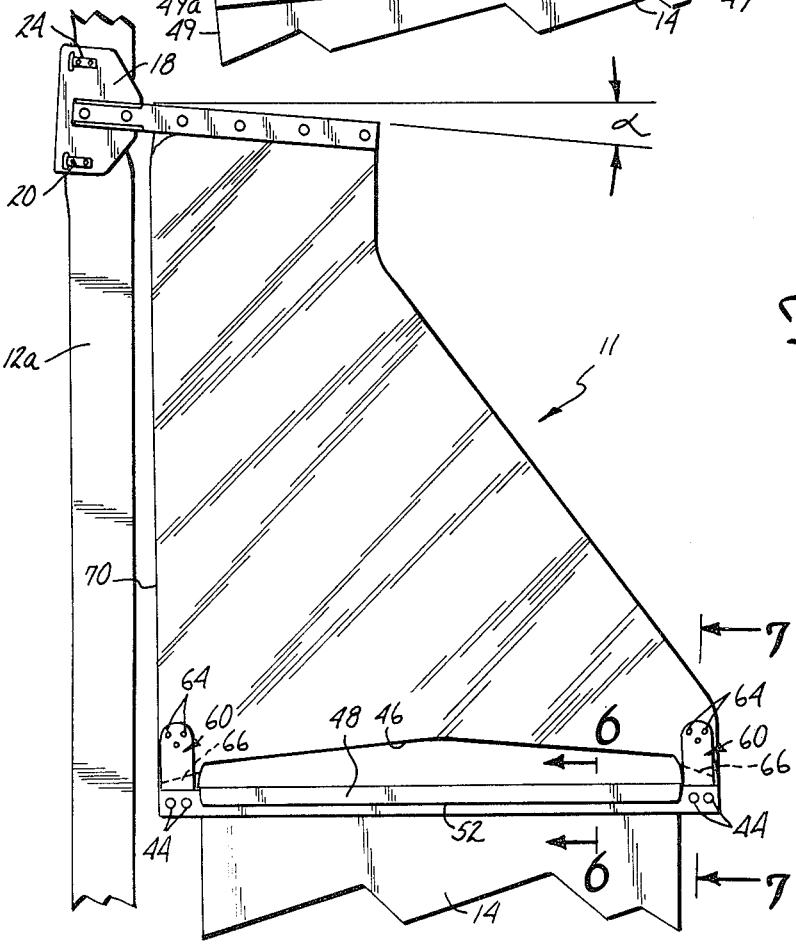
FIG. 5 is a front view of the connector device attached to the leader belt pulling photographic print paper under tension.

Pull bar 42 is spaced from leader bar 30 in an oblique relationship, the spaced relationship being established and fixed by flexible connector flap 38. Preferably, the pull bar 42 and leader bar 30 have longitudinal axes that converge on the same side of connector flap 38 as edge 40. Pull bar 42 also forms an acute angle with leader belt 12*a* when in its initial position. Print paper web 14 is attached to pull bar 42 so that longitudinal edges 49 of web 14 are perpendicular to pull bar 42. Tension is placed on connector device 11 of the present invention when leader belt 12*a* starts in motion, and pull bar 42 moves from its initial position to a position which is perpendicular to leader belt 12*a*, and print paper web 14, therefore, is then aligned substantially parallel to leader belt 12*a*. Leader bar 30, since its position with respect to pull bar 42 is set by flexible connector flap 38, moves from its perpendicular position with respect to leader belt 12*a* (as shown in FIG. 4), to a position expressed by angle $\alpha$ (as shown in FIG. 5). Angle $\alpha$ has a typical range between 4° to 6° and is, of course, equal to the angle formed by the longitudinal axes of bars 30 and 42. Belt clip 18 bends leader belt 12*a* slightly to allow leader bar 30, connector flap 38 and pull bar 42 to shift to the position shown in FIG. 5. Angle $\alpha$ has an empirical value which is a function of the tension of belt 12*a*, the material from which belt 12*a* is made, the material from which the connective flap 38 is made, and other variables not fully known or understood at the present time.

Figure 6:
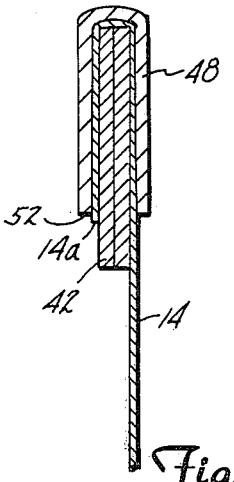
FIG. 6 is a cross-sectional view of the pull bar and paper clip of the connector device taken along section 6—6 in FIG. 5.

Print paper web 14 is attached to pull bar 42 by threading a leading end 14*a* of print paper web 14 through opening 46. Print paper 14 is then folded back on itself so that longitudinal edges 49*a* of leading end 14*a* are aligned with longitudinal edges of web 14. This procedure "squares" or positions the print paper web 14 so that its longitudinal edges 49 are perpendicular to pull bar 42. As shown in FIGS. 4–6, clip 48 holds print paper web 14 against pull bar 42 by pressing leading end 14*a* of print paper web 14 across the top and on two sides of pull bar 42. The overlapping portion of leading end 14*a* of print paper web 14 is then torn off by tearing against edge 52 of clip 48, as shown by broken line arrow 54 in FIG. 4. This procedure for attaching print paper web 14 to connector device 11 is easily and quickly performed in the dark, as is required since exposure to light would destroy the undeveloped photographic images on web 14.

Figure 7:
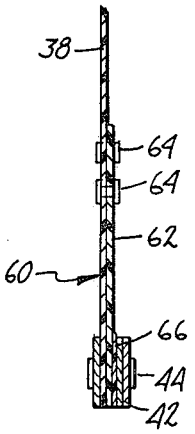
FIG. 7 is a cross-sectional view of the reinforcing member attached to the flexible connective flap and pull bar taken along section 7—7 in FIG. 5.

Flexible connector flap 38 preferably has reinforced sections 60, as illustrated in FIGS. 4, 5 and 7. Reinforcing member 62 is fastened adjacent connector flap 38 by being sandwiched between both halves of pull bar 42 and is held in place by rivets 44 at one end. The portion of reinforced section 60 not sandwiched between halves of pull bar 42 is fastened directly to flexible connector flap 38 by rivets 64. In the preferred embodiment, portion 66 of flexible connector flap 38 is folded over each reinforced section 60 such that portion 66 forms a part of the boundary of opening 46 nearest pull bar 42. Reinforced sections 60 and portions 66 reinforce the connection of flexible connector flap 38 to pull bar 42 to prevent inadvertent damage due to cutting by clip 48. The danger of damage arises when clip 48 is clipped over pull bar 42 and print paper web 14. Typically, one end of clip 48 is slid in the dark along pull bar 42 unitl it engages one of the reinforced sections 60. It has been found that in the absence of reinforced sections 60, repeated engagement of the clip 48 against an unreinforced section results in that section being gradually cut. Reinforcing members 62 eliminate this potential cause of failure of device 11.

In one particularly successful embodiment of the present invention, in which connector device 11 was used in conjunction with a Pako CP6000 paper processor, length "L" of the leader bar was between about 5 and about 6 inches. The connective flap member 38 was between about 12 and about 13 inches long along inside edge 70. Connective flap member 38 is generally limited in length by the space available in connecting the leader bar to the belt and attaching print paper at the leading end of the processor. Pull bar 42 had a total length of between about 12.5 and about 13 inches and the angle $\beta$ was approximately 35°. Opening 46 was approximately 11 inches in length, accommodating print paper up to 11 inches in width. The angle $\alpha$ as illustrated in FIG. 5, was approximately between b 4° and about 6°, resulting in print paper web 14 being positioned parallel to leader belt 12*a* when belt 12*a* was driven.

The device of the present invention allows an operator to quickly change from one paper width to another in a dark room environment by attaching connector device 11 of the present invention to one of the leader belts of processor 10 and attaching print paper web 14 to pull bar 42 of device 11, as described above. Print paper web 14 is attached perpendicularly to pull bar 42 (which simplifies attachment in the dark) and is automatically "squared" with processor 10 when tension is applied to connector device 11. When print paper web 14 is pulled by leader belt 12*a*, print paper web 14 will not be fed in a skewed manner through the processor 10. Not only is efficiency increased in changing print paper rolls, but print paper waste is kept to a minimum since each roll is initially fed in "square" with respect to the processor 10.

Although the present invention has been described with reference to preferred embodiments, persons skilled in the art will recognize that changes may be made in form and detail without departing from the spirit and scope of the invention.

What is claimed is:

1. A device for attaching a photographic print paper web to a leader belt of a photographic processor and for leading the print paper web through the processor, the device comprising:

belt clip means for attachment to the leader belt;

a leader bar rigidly attached to the belt clip means;

a pull bar spaced behind the leader bar, the pull bar being adapted to have a leading end of the print paper web attached thereto; and a flexible connective member connecting the leader bar and the pull bar in a fixed non-parallel relationship such that when the leader belt is placed in motion, tension is transmitted to the print paper web from the leader belt to cause the leader bar to move from a first position to a second position with respect to the leader belt and the pull bar to move to a perpendicular position with respect to the leader belt, such that the print paper web attached to the pull bar is aligned parallel to the leader belt.

2. The device of claim 1 wherein the flexible connective member is made of ethylene chlorinated tetraflourethylene.

3. The device of claim 1 wherein the flexible connective member has an opening adjacent the pull bar sufficiently large for a leading end of the print paper web to extend therethrough and around the pull bar, and the device further comprising clip means for holding the print paper in a fixed position with respect to the pull bar.

4. The device of claim 3 wherein the pull bar is more than about 8 inches long and the opening in the connective flap member is at least 8 inches wide.

5. The device of claim 3 and further comprising reinforcing means for reinforcing portions of the flexible connective member nearest the opening and adjacent to the pull bar.

6. The device of claim 1 wherein the leader bar in the first position is perpendicular to the leader belt.

7. The device of claim 1 wherein the pull bar is adapted to receive the print paper perpendicularly to the longitudinal axis of the print paper.

8. The device of claim 1 wherein the width of the flexible connective member increases from the leader bar to the pull bar.

9. The device of claim 1 wherein the leader bar and the pull bar have longitudinal axes which converge on a side of the flexible connective member furthest from the leader belt.

10. The device of claim 9 wherein the longitudinal axes of the leader bar and the pull bar form an angle of between about 4° and about 6°.

11. The device of claims 1, 9 or 10 wherein the leader bar has a length of between about 5 inches and about 6 inches, the pull bar has a length of between about 12.5 inches and about 13 inches, and the connective member has a length of between about 12 inches and about 13 inches.

12. The device of claim 1 wherein the pull bar forms an acute angle with the leader belt when the leader bar is in the first position.

13. A device for attaching a photographic print paper web to a leader belt for leading the print paper web through a photographic processor, the device comprising:

a sheet having a flexible center section, and having a rigid lead end and a rigid pulling end in a non-parallel relationship;

means for attaching the print paper to the pulling end; and means for attaching the sheet to the leader belt proximate the rigid lead end such that when the leader belt is placed in motion, the print paper web is oriented substantially parallel to the leader belt.

14. The device of claim 13 wherein the means for attaching the print paper to the pulling end includes:

a pull bar attached to the flexible center section of the sheet in a non-parallel relationship to the lead end, the pull bar and sheet defining an opening for insertion of the print paper web therethrough; and clip means for holding the print paper web to the pull bar in a fixed position.

15. A method of attaching a photographic print paper web to a leader belt for leading the print paper web through a photographic processor, the method comprising:

attaching a connector device with a pull bar to the leader belt;

positioning a free end of the print paper web around the pull bar;

folding the free end of the print paper web back over the web so that the free end overlaps a portion of the web;

aligning longitudinal edges of the free end with longitudinal edges of the portion of the web which it overlaps to perpendicularly position the web with respect to the pull bar; and attaching a clip over the pull bar and the print paper web so that the clip engages the print paper web across substantially the entire transverse width of the print paper web to fixedly hold the print paper web in position.

16. The method of claim 15 and further comprising:

trimming the free end by tearing the free end against an edge of the clip.

17. A device for attaching a photographic print paper web to a leader belt for leading the print paper web through a photographic processor, the device comprising:

a leader bar;

means for attaching the leader bar to the leader belt;

a flexible connective member attached at a forward end to the leader bar;

a pull bar attached to a rearward end of the flexible connective member to define an opening for permitting a free end of the print paper to be positioned around the pull bar; and clip means for holding the print paper against the pull bar, the clip means being attachable over the pull bar to engage the print paper web across substantially the entire transverse width of the print paper web.

* * * * *